US007581522B2

(12) United States Patent
Enokida

(10) Patent No.: US 7,581,522 B2
(45) Date of Patent: Sep. 1, 2009

(54) RESIN INTAKE MANIFOLD

(75) Inventor: Satoshi Enokida, Aki-gun (JP)

(73) Assignee: DaikyoNishikawa Corporation, Hiroshima (JP)

( * ) Notice: Subject to any disclaimer, the term of this patent is extended or adjusted under 35 U.S.C. 154(b) by 75 days.

(21) Appl. No.: 11/961,518

(22) Filed: Dec. 20, 2007

(65) Prior Publication Data

US 2008/0178831 A1 Jul. 31, 2008

(30) Foreign Application Priority Data

Jan. 29, 2007 (JP) ..... 2007-017745

(51) Int. Cl.
*F02M 35/10* (2006.01)

(52) U.S. Cl. ..... 123/184.34; 123/184.47; 123/184.61

(58) Field of Classification Search .....
123/184.24–184.26, 184.34–184.36, 184.42–184.44, 123/184.47–184.49, 184.61
See application file for complete search history.

(56) References Cited

U.S. PATENT DOCUMENTS 5,896,838 A * 4/1999 Pontopiddan et al. .. 123/184.47
6,647,940 B2 * 11/2003 Wada et al. ..... 123/184.32

FOREIGN PATENT DOCUMENTS

JP 9-177624 A 7/1997

* cited by examiner

*Primary Examiner*—Noah Kamen
(74) *Attorney, Agent, or Firm*—Roberts Mlotkowski Safran & Cole, P.C.; Thomas W. Cole

(57) ABSTRACT

Upper and lower split components include upper and lower concave parts, respectively, forming the inner periphery of an intake pipe. An internal pipe is placed between the upper and lower concave parts. The upper concave part is formed a distance away from the outer periphery of the internal pipe. The outer periphery of the internal pipe is provided with a fitting part fitted into the lower concave part and a sealing part accommodated in an accommodation recess formed in the upper concave part. The inner face of the accommodation recess and the sealing part are formed along the direction of vibration of vibration welding and are in contact with each other.

5 Claims, 9 Drawing Sheets

RESIN INTAKE MANIFOLD

CROSS-REFERENCE TO RELATED APPLICATION

This application claims priority under 35 USC 119 to Japanese Patent Application No. 2007-17745 filed on Jan. 29, 2007, the entire contents of which are incorporated herein by reference.

BACKGROUND OF THE INVENTION (a) Field of the Invention

This invention relates to resin intake manifolds such as provided in intake systems of motor vehicle engines.

(b) Description of the Related Art

Surge tank-integrated intake manifolds are conventionally known as resin intake manifolds of the above kind (see, for example, Published Japanese Patent Application No. H09-177624). The surge tank-integrated intake manifold disclosed in the patent document is formed by integrating a plurality of intake pipes forming intake passages each for supplying intake air to associated one of cylinders of a multi-cylinder engine with a surge tank connected to the upstream sides of the intake pipes. The intake pipes are internally provided with individual internal pipes formed to extend to the interior of the surge tank. The provision of the internal pipes allows the intake passages in the intake pipes to be extended to the interior of the surge tank, thereby enhancing the air intake performance and the silencing effect.

The manifold body of the intake manifold is composed of two split components split along a radial direction of the intake pipes. Each split component is provided with concave parts each of which forms a half of the inner periphery of the associated intake pipe. Each internal pipe is configured to be placed between an opposed pair of concave parts of both the split components. With the internal pipes put between their associated opposed pairs of concave parts, both the split components are joined together by vibration welding. Thus, the internal pipes are held radially gripped between their associated pairs of concave parts of the split components.

Since the internal pipes must be placed in the associated intake pipes as described above, it is necessary that in producing the intake manifold, the outer peripheries of the internal pipes should be fitted onto their associated concave parts of one of the split components to combine the internal pipes with the one split component and, in this state, the other split component should be vibrated with respect to the one split component to weld them together. In this case, in order to provide a firm and reliable vibration welding, a clearance corresponding to the amplitude of vibrations during vibration welding must be kept between each concave part of the other split component and the outer periphery of the associated internal pipe to make the other split component easy to vibrate. If the clearance is kept, part of intake air in the surge tank may flow into the clearance, bypass the internal pipe and then directly reach the downstream side of the intake pipe. This reduces effects due to provision of the internal pipes, such as enhancement in air intake performance and silencing effect.

The present invention has been made in view of the foregoing points and, therefore, an object of the present invention is that when one or more internal pipes are placed in a manifold body which is to be obtained by joining a plurality of split components by vibration welding, a firm and reliable vibration welding can be implemented and, concurrently, intake air in the surge tank can be prevented from bypassing the internal pipes and flowing directly downstream thereof, thereby providing a sufficient effect of enhancing the air intake performance and a sufficient silencing effect both due to provision of the internal pipes.

SUMMARY OF THE INVENTION

A first aspect of the invention provides a resin intake manifold including: a manifold body including an intake pipe and a surge tank connected to an end of the intake pipe located upstream in the flow of intake air; and an internal pipe placed in the intake pipe and extending to the interior of the surge tank, the manifold body being composed of first and second split components joined together along a parting plane extending radially and longitudinally of the intake pipe by vibration welding, wherein the first and second split components include first and second concave parts, respectively, forming the inner periphery of the intake pipe so that a downstream part of the internal pipe is placed between the first and second concave parts, the second concave part is formed a distance away from the outer periphery of the internal pipe, the internal pipe includes a fitting part formed in a portion of the outer periphery of the downstream part thereof corresponding to the first concave part and fitted into the first concave part and a sealing part formed on a portion of the outer periphery of the downstream part thereof corresponding to the second concave part and extending radially outwardly, the second concave part has an accommodation recess accommodating the sealing part, and the inner face of the accommodation recess and the sealing part are formed along the direction of vibration of the vibration welding and are in contact with each other.

According to the first aspect of the invention, in vibrating the second split component with the fitting part of the internal pipe fitted to the first concave part to combine the internal pipe with the first split component, the internal pipe is prevented from interfering with the concave part of the second split component and the second split component is thereby easily vibrated. Thus, the first and second split components can be firmly and reliably joined together by vibration welding. Furthermore, since a sealing part is provided on a portion of the outer periphery of the internal pipe corresponding to the second concave part, an accommodation recess for accommodating the sealing part is provided in the second concave part and the inner face of the accommodation recess and the sealing part are in contact with each other, a seal can be formed between the outer periphery of the internal pipe and the second concave part of the second split component. Thus, intake air in the surge tank is prevented from bypassing the internal pipe and flowing directly downstream of the internal pipe, whereby the effect of enhancing the air intake performance and the silencing effect due to provision of the internal pipe can be well exhibited. Furthermore, since the inner face of the accommodation recess and the sealing part are formed along the direction of vibration of vibration welding, they are prevented from hampering the vibration welding.

In a second aspect of the invention, related to the first aspect of the invention, the sealing part has a sealing part-side inclined face inclined with respect to the direction of pressure application during the vibration welding, part of the inner face of the accommodation recess is an accommodation recess-side inclined face conforming to the sealing part-side inclined face, and the sealing part-side inclined face and the accommodation recess-side inclined face are in contact with each other.

According to the second aspect of the invention, since the sealing part-side inclined face inclined to the direction of pressure application during vibration welding is in contact with the accommodation recess-side inclined face, both the split components can be welded together with the sealing part-side inclined face pressed against the accommodation recess-side inclined face by a pressing force during the vibration welding. Thus, the sealing performance can be further enhanced.

In a third aspect of the invention, related to the first or second aspect of the invention, the intake pipe comprises a plurality of intake pipes, the internal pipe comprises a plurality of internal pipes, one internal pipe in each of the plurality of intake pipes, and the sealing part comprises a plurality of sealing parts, all or some of the plurality of sealing parts being integral.

According to the third aspect of the invention, a plurality of internal pipes can be joined by forming the sealing parts of the plurality of internal pipes into an integral piece. Thus, the number of parts to be assembled into both the split components can be reduced, thereby enhancing the assemblability.

In a fourth aspect of the invention, related to any one of the first to third aspects of the invention, the sealing part includes a flexible projection in contact in a bent position with the inner face of the accommodation recess.

According to the fourth aspect of the invention, since the flexible projection of the sealing part comes into contact in a bent position with the inner face of the accommodation recess, variations in the molding accuracy of the sealing part and the accommodation recess can be absorbed by the bending deformation of the flexible projection, thereby providing a reliable seal.

In a fifth aspect of the invention, related to the third aspect of the invention, the plurality of intake pipes are radially juxtaposed, each radially adjacent pair of the plurality of internal pipes are joined by a connecting part provided therebetween, one of the first and second split components includes a welding raised part welded to the other split component, the welding raised part being located between each radially adjacent pair of the plurality of internal pipes, and the connecting part has a through hole receiving the welding raised part.

According to the fifth aspect of the invention, since a through hole is formed in the connecting part joining each adjacent pair of the plurality of internal pipes and a welding raised part to be inserted into the through hole is provided on one of the first and second split components, the adjacent pair of internal pipes can be positioned, during the production of the intake manifold, with the welding raised part inserted in the through hole. In addition, since the welding raised part is welded, the welding strength of the first and second split components can be further enhanced.

DETAILED DESCRIPTION OF THE INVENTION

Hereinafter, an embodiment of the invention will be described in detail with reference to the drawings. Note that the following description of the preferred embodiment is merely illustrative in nature and is not intended to limit the scope, applications and use of the invention.

Figure 1:
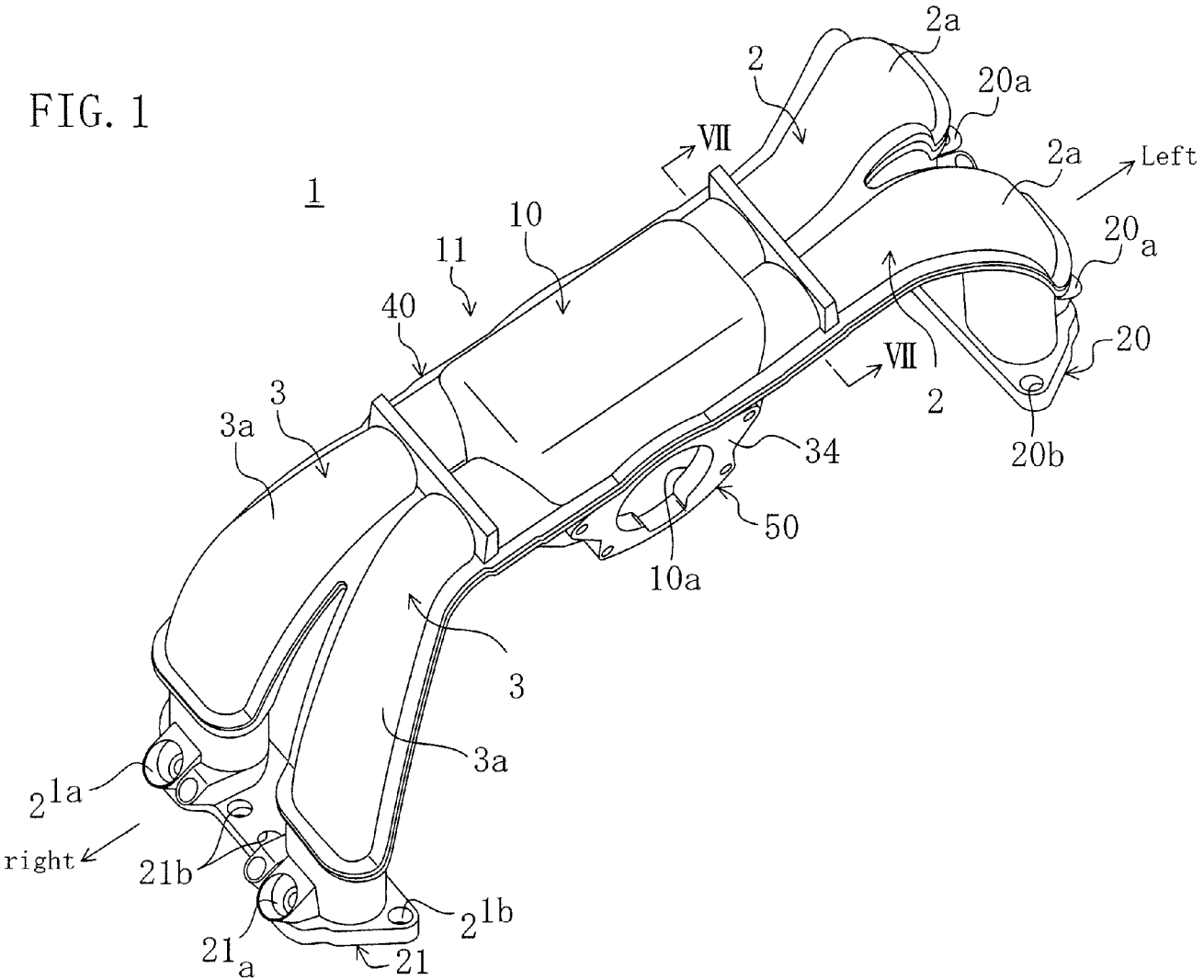
FIG. 1 is a perspective view of a resin intake manifold according to an embodiment of the invention.
Figure 2:
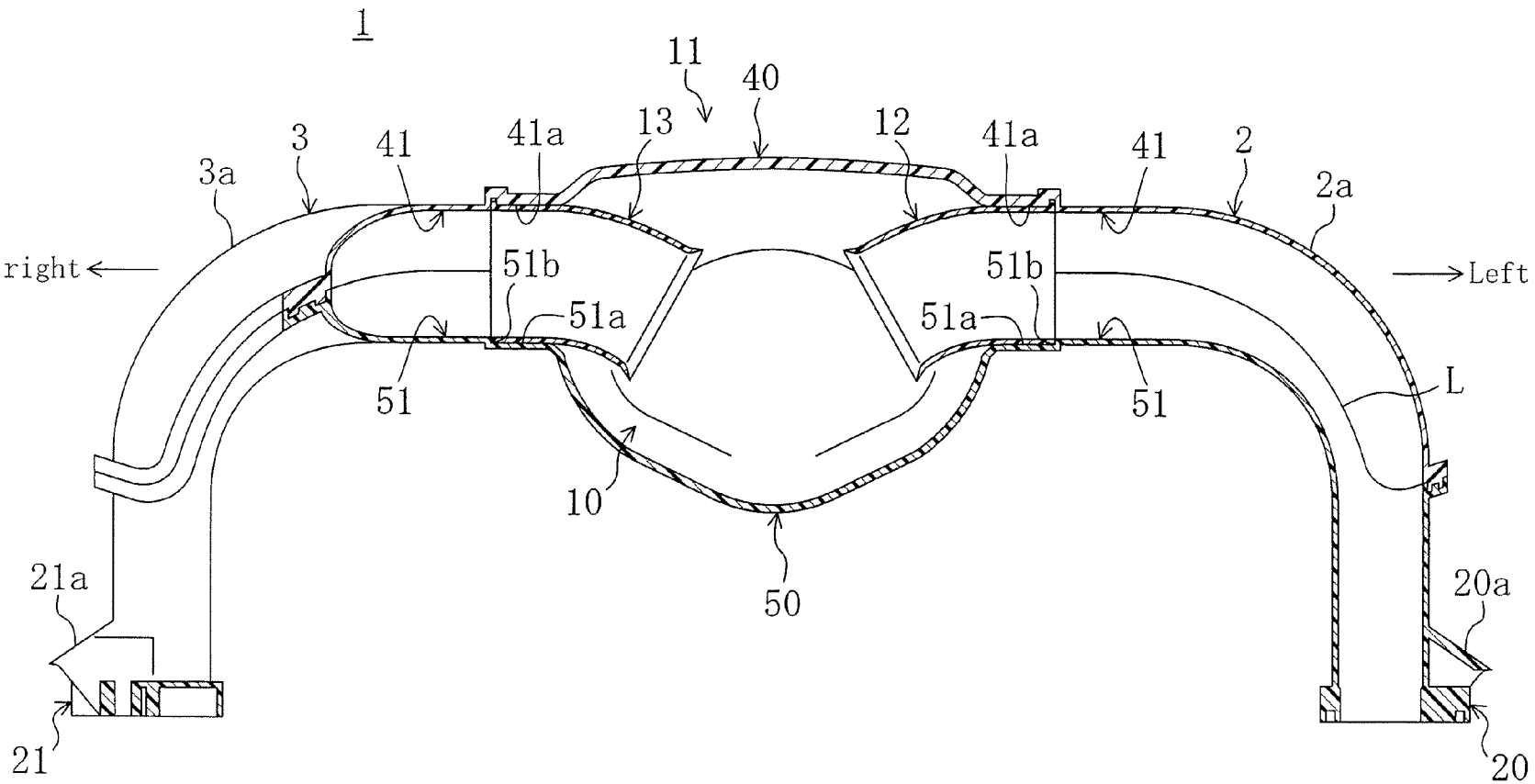
FIG. 2 is a partly cross-sectional view of the intake manifold.

FIG. 1 shows a resin intake manifold 1 according to an embodiment of the invention. The intake manifold 1 is used by being mounted to a horizontally opposed four-cylinder engine (not shown). The intake manifold 1 includes a manifold body 11 including four intake pipes 2, 2, 3 and 3 and a surge tank 10 connected to ends of the intake pipes 2, 2, 3 and 3 located upstream in the flow of intake air, and internal pipes 12, 12, 13 and 13 placed in the intake pipes 2, 2, 3 and 3, one internal pipe in each intake pipe. The intake pipes 2, 2, 3 and 3 constitute individual intake passages each directing intake air to the intake port of the associated cylinder of the engine. As shown in FIG. 1, out of the four intake pipes 2, 2, 3 and 3, two intake pipes 2 and 2 for the left bank of the engine are radially juxtaposed to make a pair. On the other hand, the other two intake pipes 3 and 3 for the right bank of the engine are likewise radially juxtaposed to make another pair. As shown in FIG. 2, the left pair of intake pipes 2 and 2 and the right pair of intake pipes 3 and 3 are configured so that their respective parts upstream in the flow of intake air (towards the surge tank 10) extend substantially horizontally in opposite directions to each other to conform to the outer shape of the engine and these horizontal parts of the intake pipes 2, 2, 3 and 3 join individual curved parts 2*a*, 2*a*, 3*a* and 3*a* curved downward and extending downstream in the flow of intake air. Furthermore, the downstream parts of the intake pipes 2, 2, 3 and 3 extend substantially vertically downward from the curved parts 2*a*, 2*a*, 3*a* and 3*a*.

The left pair of intake pipes 2 and 2 are provided at their downstream ends with a flange 20 which is to be fastened to the cylinder head of the engine. The flange 20 extends substantially horizontally and connects both the intake pipes 2 and 2. The flange 20 is provided with injector attachment parts 20*a* and 20*a*, one for each intake pipe 2, to each of which a fuel injector is to be attached. Furthermore, the flange 20 is provided also with a plurality of fastening holes 20*b* through which the flange 20 is to be bolted to the cylinder head. The right pair of intake pipes 3 and 3 are also provided at their downstream ends with a flange 21 having like injector attachment parts 21*a* and 21*a* and fastening holes 21*b*.

Figure 3:
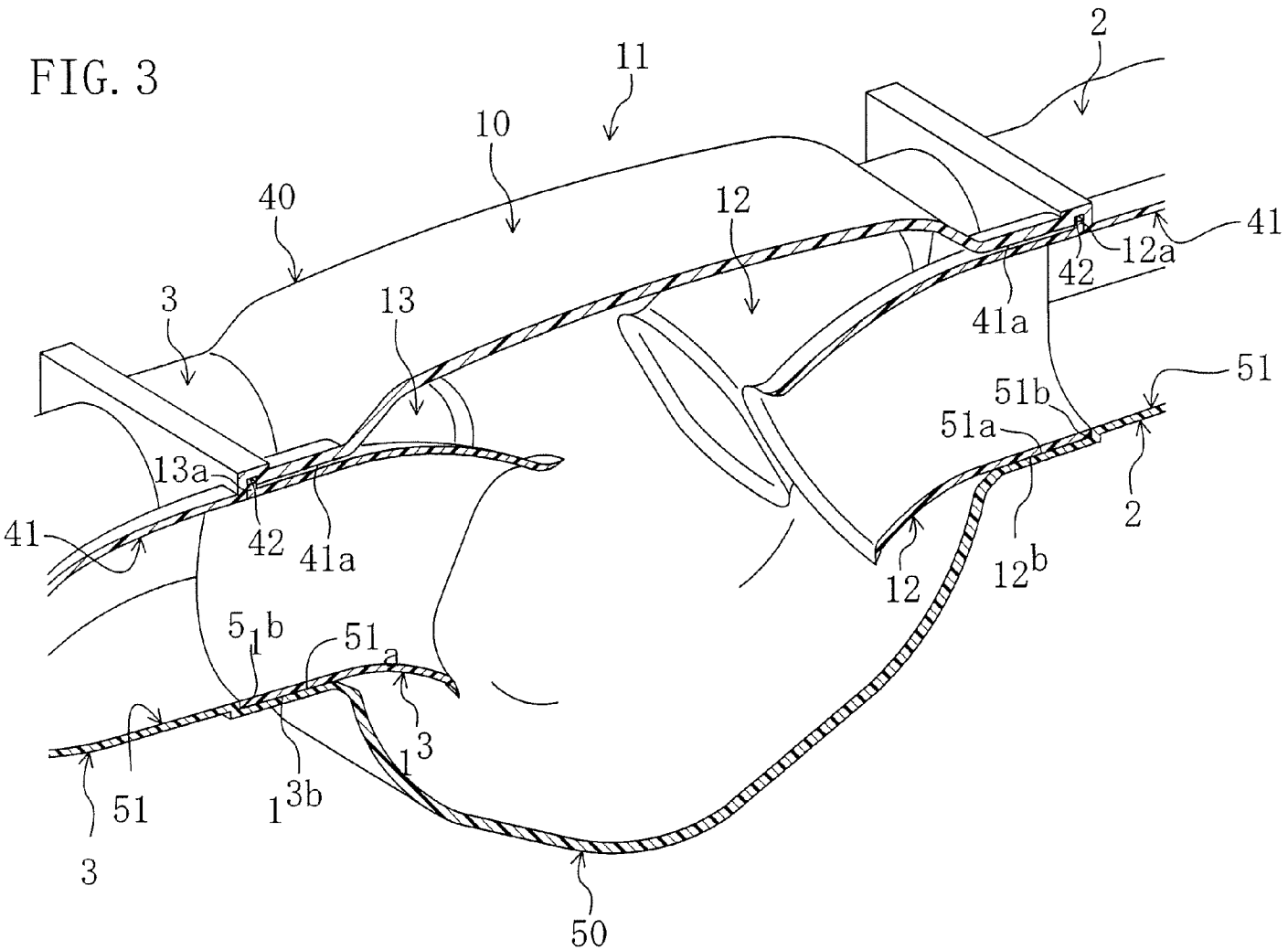
FIG. 3 is an enlarged cross-sectional view showing a surge tank and its vicinity in the intake manifold.

The internal pipes 12, 12, 13 and 13 are fixed to the associated intake pipes 2, 2, 3 and 3 by placing their respective parts downstream in the flow of intake air into the associated intake pipes 2, 2, 3 and 3. As also shown in FIG. 3, with the internal pipes 12, 12, 13 and 13 fixed to the intake pipes 2, 2, 3 and 3, the upstream parts of the internal pipes 12, 12, 13 and 13 extend to the interior of the surge tank 10, thereby implementing the extension of the intake passages. Furthermore, the downstream parts of the internal pipes 12, 12, 13 and 13 extend substantially horizontally to conform to the horizontal parts of the intake pipes 2, 2, 3 and 3, and the upstream parts thereof gently bend downward. The upstream ends of the internal pipes 12, 12, 13 and 13 have the shape of a funnel.

Figure 4:
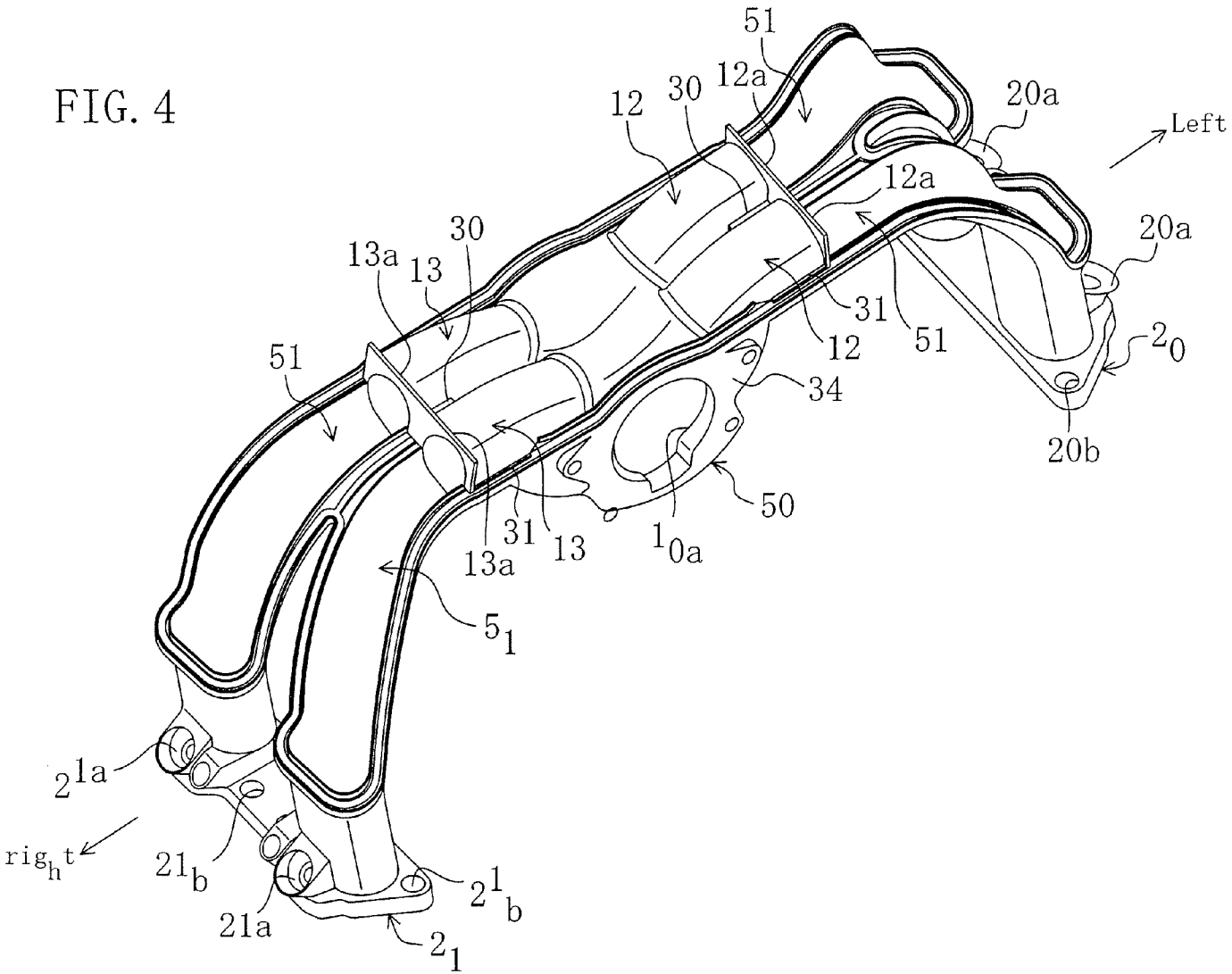
FIG. 4 is a perspective view of a lower split component when internal pipes are combined with it.
Figure 5:
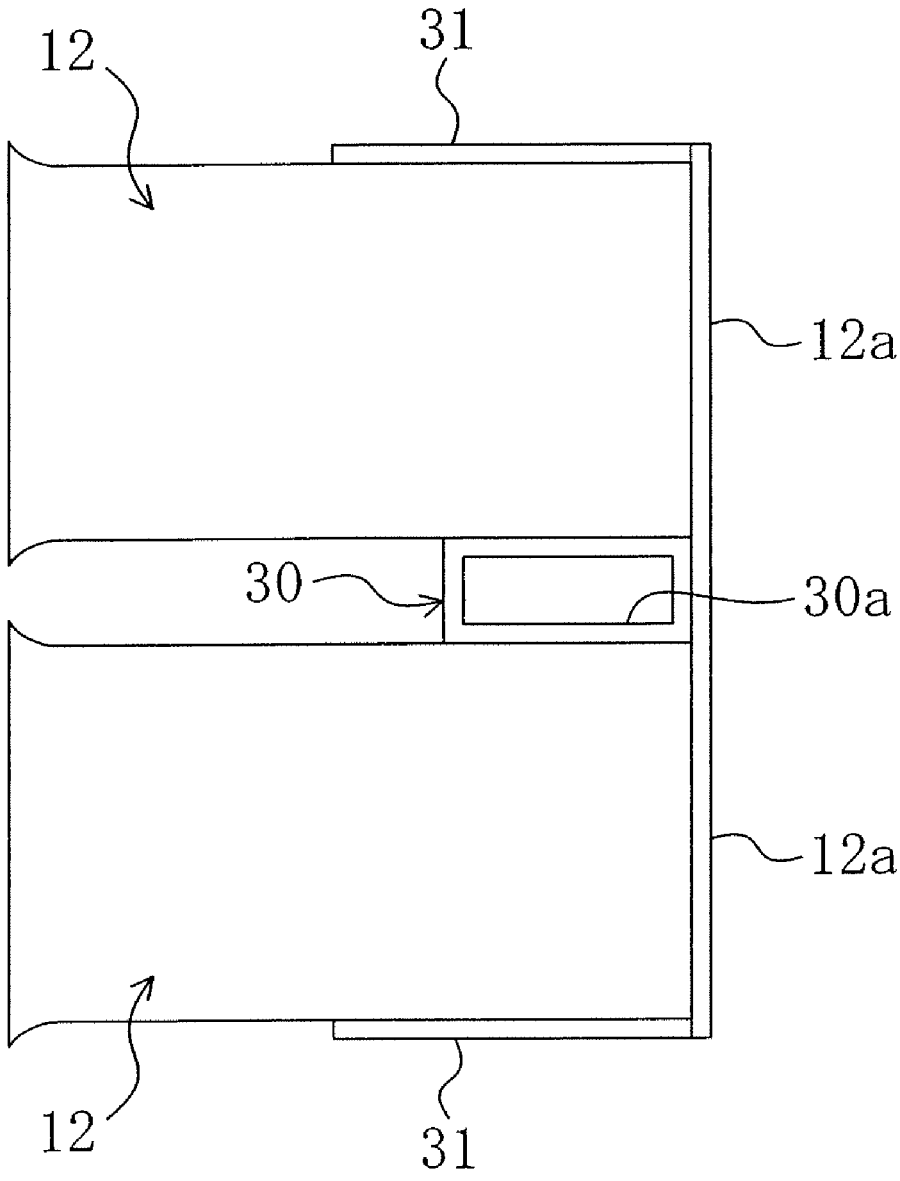
FIG. 5 is a plan view of two internal pipes joined together.

The two internal pipes 12 and 12 placed in the left pair of intake pipes 2 and 2 radially adjoin. As shown in FIGS. 4 and 5, the adjacent internal pipes 12 and 12 are joined by a connecting part 30 provided between them. The connecting part 30 has the shape of a rectangular plate and is molded integral with the outer peripheries of the downstream parts of both the internal pipes 12 and 12. The connecting part 30 has a substantially rectangular through hole 30*a* formed at its center to vertically pass through the connecting part 30. Furthermore, each internal pipe 12 has a rib 31 on the outer periphery of its downstream part on the radially opposite side to the connecting part 30. The rib 31 extends along the center line of the downstream part of the internal pipe 12.

Figure 6:
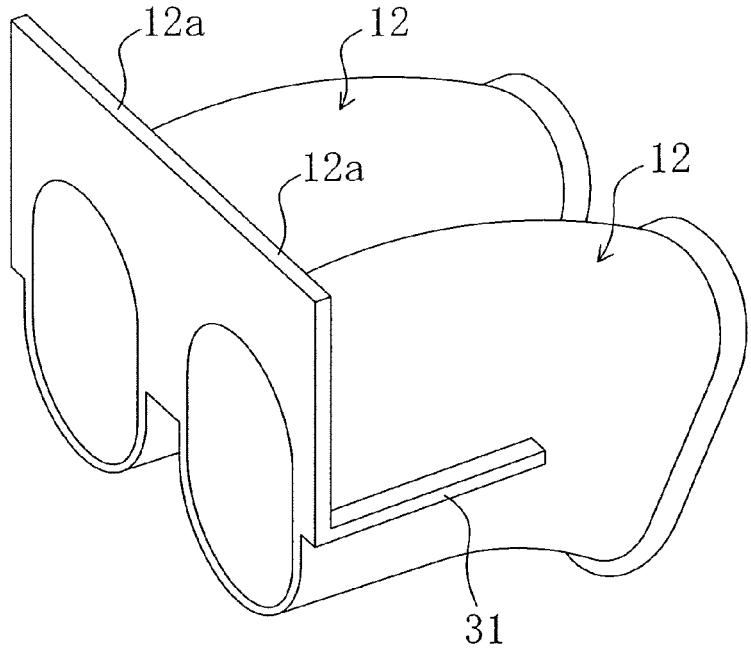
FIG. 6 is a perspective view of the two internal pipes joined together.

As shown in FIG. 6, the outer peripheries of the left pair of internal pipes 12 and 12 are integrally provided at their downstream ends with sealing plates 12*a* and 12*a* (sealing parts) extending radially outward from the outer peripheries. The sealing plates 12*a* and 12*a* are provided only on the upper halves of the internal pipes 12 and 12 and do not extend to the lower halves. The sealing plates 12*a* and 12*a* of both the internal pipes 12 and 12 are integral and, therefore, both the internal pipes 12 and 12 are joined also by the sealing plates 12*a* and 12*a*. The integral piece of sealing plates 12*a* and 12*a* has a rectangular shape long in a direction of juxtaposition of the internal pipes 12 and 12 as viewed from downstream of the internal pipes 12 and 12. Furthermore, as shown in FIG. 5, the sealing plates 12*a* and 12*a* and the connecting part 30 are also integral. The two internal pipes 13 and 13 placed in the right pair of intake pipes 3 and 3 are configured in the same manner as the left pair of internal pipes 12 and 12 and, as shown in FIG. 4, include a connecting part 30, ribs 31 and sealing plates 13*a* and 13*a* (sealing parts).

As shown in FIG. 2, the surge tank 10 is located between the left pair of intake pipes 2 and 2 and the right pair of intake pipes 3 and 3. As also shown in FIG. 3, the top wall of the surge tank 10 bulges above the level of the horizontal parts of the intake pipes 2, 2, 3 and 3. Furthermore, the bottom wall of the surge tank 10 bulges below to a greater extent than the top wall. As shown in FIGS. 1 and 4, an air inlet 10*a* opens at the peripheral wall of the surge tank 10. The peripheral part of the air inlet 10*a* is provided with a substantially vertically extending flange 34. Although not shown, the flange 34 is configured to mount a throttle valve assembly thereto. Thus, intake air filtered by an air cleaner (not shown) is taken through the throttle valve assembly into the surge tank 10, distributed through the internal pipes 12, 12, 13 and 13 to the associated intake pipes 2, 2, 3 and 3 and then sucked into the associated cylinders through their respective intake ports.

The manifold body 11 is composed of two components having a curved parting plane extending substantially along the axes of the intake pipes 2, 2, 3 and 3 (extending radially and longitudinally thereof), i.e., an upper split component 40 (a second split component) and a lower split component 50 (a first split component), and constructed so that the upper and lower split components 40 and 50 are joined together by vibration welding. The line indicated by L in FIG. 2 is the parting line lying on the parting plane of the manifold body 11. Each of the upper and lower split components 40 and 50 are injection molded from a resin material. The upper split component 40 is formed by integrally molding the top wall of the surge tank 10, the upper part of the peripheral wall of the surge tank 10 and the respective upper halves of the horizontal parts and curved parts 2*a*, 2*a*, 3*a* and 3*a* of the intake pipes 2, 2, 3 and 3. On the other hand, the lower split component 50 is formed by integrally molding the bottom wall of the surge tank 10, the lower part of the peripheral wall of the surge tank 10 and the remaining parts of the intake pipes 2, 2, 3 and 3. The flanges 20 and 21 of the intake pipes 2, 2, 3 and 3 and the flange 34 of the surge tank 10 are also molded integral with the lower split component 50, whereby the lower split component 50 has a larger size than the upper split component 40.

Figure 7:
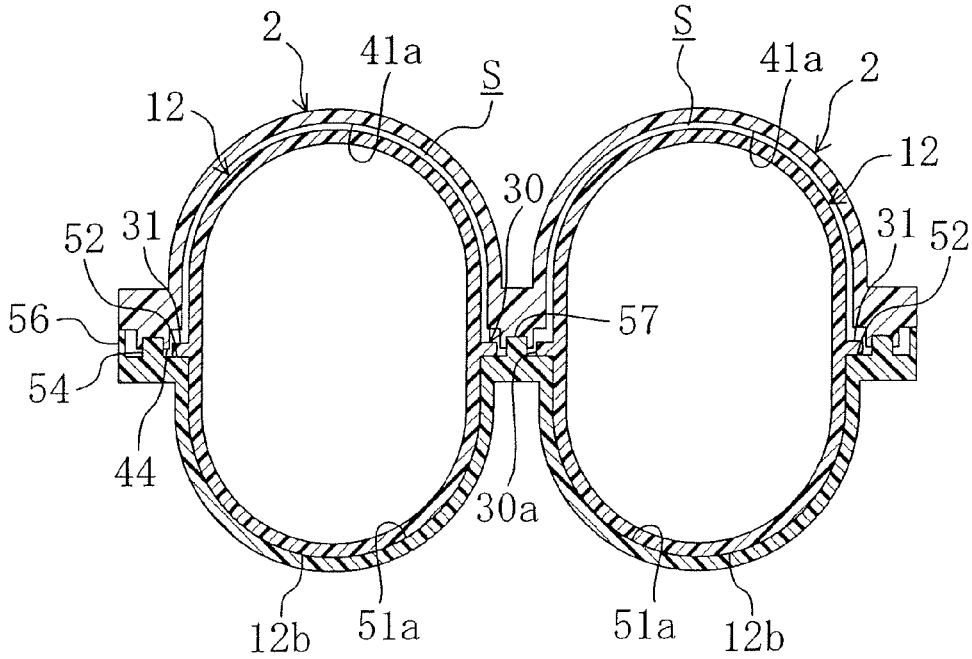
FIG. 7 is a cross-sectional view taken along the line VII-VII of FIG. 1.

The upper split component 40 includes four upper concave parts 41, 41, . . . (second concave parts) constituting upper parts of the inner peripheries of the four intake pipes 2, 2, 3 and 3. As shown in FIG. 3, respective parts of the upper concave parts 41, 41, . . . upstream in the flow of intake air are formed into individual upper expanded parts 41*a*, 41*a*, . . . having a larger diameter than the downstream parts thereof. Each upper expanded part 41*a* is disposed at a position corresponding to the upper half of the outer periphery of the downstream part of the associated internal pipe 12, 13. Furthermore, as also shown in FIG. 7, the upper expanded part 41*a* is formed a distance away from the outer periphery of the downstream part of the associated internal pipe 12, 13. Thus, a clearance S is created between each upper concave part 41 and the upper half of the outer periphery of the associated internal pipe 12, 13.

As shown in FIG. 3, each upper concave part 41 located in the left side of the manifold body 11 has an accommodation recess 42 accommodating the associated sealing plate 12*a* of the internal pipe 12. The accommodation recess 42 has a shape long in a radial direction of the internal pipe 12 to conform to the shape of the integral piece of sealing plates 12*a* and 12*a*. The depth of the accommodation recess 42 is selected so that with the sealing plate 12*a* fully accommodated therein, the edge of the sealing plate 12*a* does not come into contact with the bottom of the accommodation recess 42 (the top side thereof in FIG. 3). Furthermore, the inner face of the accommodation recess 42 is formed along the direction of extension of the integral piece of sealing plates 12*a* and 12*a* and configured so that its opposed sides come into contact with both surfaces of the sealing plates 12*a* and 12*a*. This contact of both surfaces of each sealing plate 12*a* with the inner face of the accommodation recess 42 provides a seal between the upper half of the outer periphery of the internal pipe 12 and the upper concave part 41. Each upper concave part 41 located in the right side of the manifold body 11 also has a like accommodation recess 42. The accommodation recess 42 accommodates the associated sealing plate 13*a*, thereby providing a seal between the upper half of the outer periphery of the internal pipe 13 and the upper concave part 41.

As shown in FIG. 7, the upper split component 40 has a looped, welding upper ridge 44 formed at its peripheral edge and extending downward. The welding upper ridge 44 extends to between each adjacent pair of upper concave parts 41 and 41.

Figure 8:
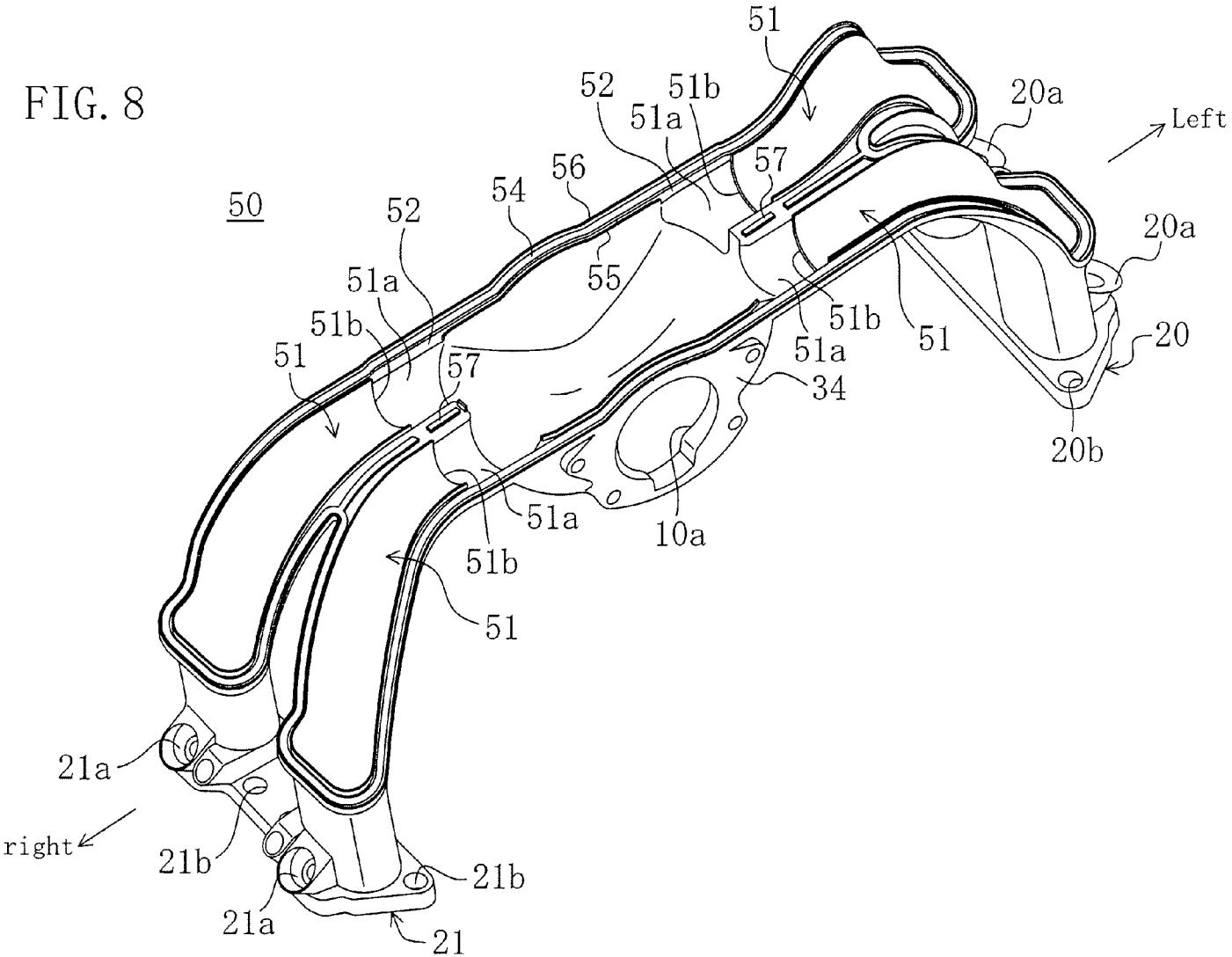
FIG. 8 is a perspective view of the lower split component.

On the other hand, as shown in FIG. 8, the lower split component 50 includes four lower concave parts 51, 51, . . . (first concave parts) constituting lower parts of the inner peripheries of the four intake pipes 2, 2, 3 and 3. Respective parts of the lower concave parts 51, 51, . . . upstream in the flow of intake air are formed into individual lower expanded parts 51*a*, 51*a*, . . . having a larger diameter than the downstream parts thereof. Each lower expanded part 51*a* is, as shown in FIG. 3, disposed at a position corresponding to the lower half of the outer periphery of the downstream part of the associated internal pipe 12, 13. Each lower expanded part 51*a* is fitted on the lower half of the outer periphery of the downstream part of the associated internal pipe 12, 13. In other words, the parts of the internal pipes 12, 12, 13 and 13 fitting to the lower expanded parts 51*a*, 51*a*, . . . provide fitting parts 12*b*, 12*b*, 13*b* and 13*b*. The fitting parts 12*b*, 12*b*, 13*b* and 13*b* of the internal pipes 12, 12, 13 and 13 are fitted on the lower expanded parts 51*a*, 51*a*, . . . in this manner, whereby the internal pipes 12, 12, 13 and 13 are combined with the lower split component 50 and the lower half of the outer periphery of each internal pipe 12, 13 comes into close contact with the associated lower concave part 51 to form a seal between them.

The formation of the lower expanded parts 51*a*, 51*a*, . . . in the lower concave parts 51, 51, . . . is accompanied by the formation of shoulders 51*b*, 51*b*, . . . bordering on the lower expanded parts 51*a*, 51*a*, . . . . The shoulders 51*b*, 51*b*, . . . fit against the downstream ends of the internal pipes 12, 12, 13 and 13. Furthermore, as shown in FIG. 8, the lower split component 50 is provided with fitting recesses 52, 52, . . . in which the associated ribs 31, 31, . . . of the internal pipes 12, 12, 13 and 13 are fitted. This configuration makes the internal pipes 12, 12, 13 and 13 difficult to displace from the lower split component 50.

The lower split component 50 has a looped lower ridge 54 formed at a portion thereof opposed to the welding upper ridge 44 and extending upward. The lower ridge 54 and the welding upper ridge 44 are joined together at their end faces by vibration welding. Furthermore, the lower split component 50 is provided with an inner vertical wall 55 and an outer vertical wall 56. The provision of the inner vertical wall 55 and the outer vertical wall 56 prevents flash produced during vibration welding from getting in the intake passages and getting out of the manifold body 11. Furthermore, the lower split component 50 has a welding raised part 57 formed between the left pair of lower expanded parts 51*a* and 51*a*. The welding raised part 57 is formed and positioned to be inserted into the through hole 30*a* of the connecting part 30 provided between the adjacent internal pipes 12 and 12. A like welding raised part 57 is formed also between the right pair of lower expanded parts 51*a* and 51*a*.

Next, a description is given of production procedures of the intake manifold 1 having the above structure. First, the upper split component 40, the lower split component 50 and the left and right pairs of internal pipes 12, 12, 13 and 13 are molded with an unshown injection molding machine. Then, as shown in FIG. 3, the fitting parts 12*b*, 12*b*, 13*b* and 13*b* are fitted onto the expanded parts 51*a*, 51*a*, . . . of the lower split component 50 to assemble the internal pipes 12, 12, 13 and 13 to the lower split component 50. Thus, as shown in FIG. 4, the internal pipes 12, 12, 13 and 13 are combined with the lower split component 50. In this assembly, as shown in FIG. 7, each welding raised part 57 is inserted into the associated through hole 30*a* and each rib 31 is fitted into the associated fitting recess 52. Thus, the internal pipes 12, 12, 13 and 13 are held positioned to the lower split component 50.

Thereafter, the upper split component 40 is assembled to the lower split component 50. In this assembly, as shown in FIG. 3, the two integral pieces of sealing plates 12*a*, 12*a*, 13*a* and 13*a* of the internal pipes 12, 12, 13 and 13 are accommodated into the accommodation recesses 42 and 42 of the lower split component 40. Then, the upper split component 40 and the lower split component 50 are fixed to the associated jigs of a vibration welding machine (not shown) and given pressure by the machine. Thus, the upper split component 40 is pressed against the lower split component 50, so that the upper ridge 44 of the upper split component 40 abuts against the lower ridge 54 of the lower split component 50. In this state, the upper split component 40 is vibrated along the radial direction of the horizontal parts of the intake pipes 2, 2, 3 and 3, i.e., the radial direction of the internal pipes 12, 12, 13 and 13. Since, as shown in FIG. 7, a clearance S is created between the outer periphery of each internal pipe 12, 13 and the associated expanded part 41*a* of the upper split component 40, the internal pipe 12, 13 is prevented from interfering with the upper split component 40 during the vibration and the upper split component 40 is thereby easily vibrated. Furthermore, since the integral pieces of sealing plates 12*a*, 12*a*, 13*a* and 13*a* and the inner faces of the accommodation recesses 42 and 42 are formed along the radial direction of the internal pipes 12, 12, 13 and 13, i.e., the direction of the vibration, the sealing plates 12*a*, 12*a*, 13*a* and 13*a* are prevented from hampering the vibration of the upper split component 40.

Furthermore, the vibration welding of the upper split component 40 and the lower split component 50 provides contact of the sealing plates 12*a*, 12*a*, 13*a* and 13*a* with the inner faces of the accommodation recesses 42 and 42 and thereby forms a seal between the upper half of the outer periphery of each internal pipe 12, 13 and the associated upper concave part 41 of the upper split component 40. Thus, the intake air in the surge tank 10 can be prevented from bypassing the internal pipes 12, 12, 13 and 13 and flowing directly downstream of the internal pipes 12, 12, 13 and 13.

As described previously, in the intake manifold 1 according to this embodiment, each internal pipe 12, 13 is placed between the associated upper concave part 41 of the upper split component 40 and the associated lower concave part 51 of the lower split component 50 and the upper concave part 41 is formed a distance away from the outer periphery of the associated internal pipe 12, 13. Therefore, in vibrating the upper split component 40 with the internal pipes 12, 12, 13 and 13 combined with the lower split component 50, each internal pipe 12, 13 is prevented from interfering with the upper concave part 41 and the upper split component 40 is thereby easily vibrated. Furthermore, since the integral pieces of sealing plates 12*a*, 12*a*, 13*a* and 13*a* and the inner faces of the accommodation recesses 42 and 42 are formed along the direction of the vibration, the sealing plates 12*a*, 12*a*, 13*a* and 13*a* are prevented from hampering the vibration of the upper split component 40. For these reasons, the upper split component 40 and the lower split component 50 can be firmly and reliably joined together by vibration welding. In addition, since the sealing plates 12*a*, 12*a*, 13*a* and 13*a* of the internal pipes 12, 12, 13 and 13 come into contact with the associated inner faces of the accommodation recesses 42 and 42, the intake air in the surge tank 10 can be prevented from bypassing the internal pipes 12, 12, 13 and 13, whereby the effect of enhancing the air intake performance and the silencing effect due to provision of the internal pipes 12, 12, 13 and 13 can be well exhibited.

Furthermore, since each adjacent pair of internal pipes 12 and 12 are joined by forming the sealing plates 12*a* and 12*a* of the internal pipes 12 and 12 into an integral piece, the number of parts can be reduced. This enhances the assemblability of the internal pipes 21 and 12.

Furthermore, a through hole 30*a* is formed in the connecting part 30 joining each adjacent pair of internal pipes 12 and 12 and a welding raised part 57 to be inserted into the through hole 30*a* is provided on the lower split component 50. Therefore, during production, each adjacent pair of internal pipes 12 and 12 can be positioned with the welding raised part 57 inserted in the through hole 30*a*. In addition, since the welding raised part 57 is welded, the welding strength of the upper split component 40 and the lower split component 50 can be further enhanced.

Although in the above embodiment each adjacent pair of internal pipes 12 and 12 are formed integral by joining them by the connecting part 30 and the sealing plates 12*a* and 12*a*, the present invention is not limited to this. For example, each adjacent pair of internal pipes 12 and 12 may be separated from each other by eliminating the connecting part 30 and forming the sealing plates 12*a* and 12*a* separately from each other.

Figure 9:
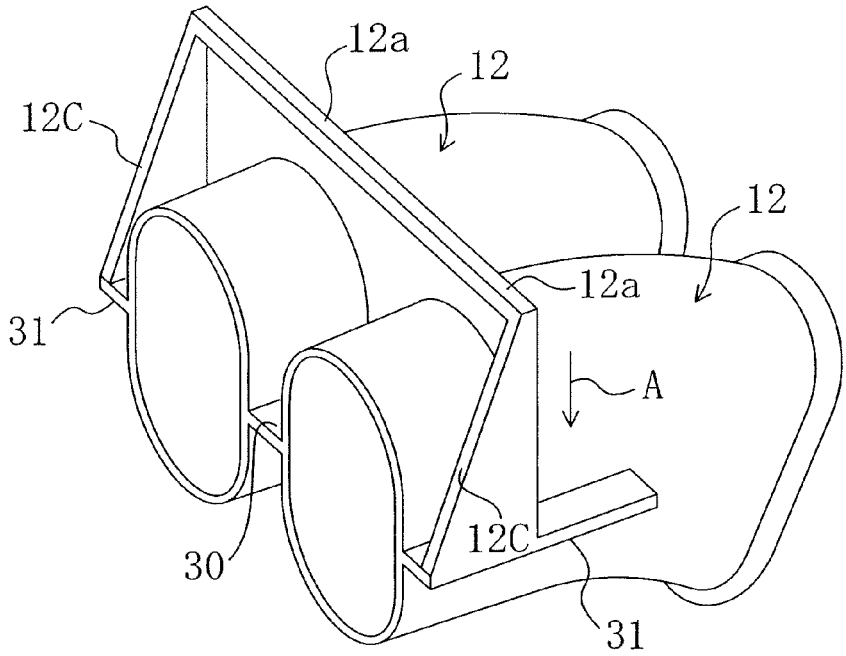
FIG. 9 is a corresponding view of FIG. 6 according to Modification 1 of the above embodiment.

Alternatively, as in Modification 1 shown in FIG. 9, each sealing plate 12*a* may have a sealing plate-side inclined face 12*c* (sealing part-side inclined face) inclined with respect to the direction of pressure application during vibration welding (the vertical direction shown in the arrow A in FIG. 9). The sealing plate-side inclined face 12*c* is located on the downstream side of the sealing plate 12*a* towards the downstream end of the internal pipe 12 and inclined to be more downstream with approach to its lower end. In this case, although not shown, the associated accommodation recess 42 is provided with an accommodation recess-side inclined face (not shown) conforming to the sealing plate-side inclined face 12*c*. The sealing plate-side inclined face 12*c* and the accommodation recess-side inclined face are parallel to and in contact with each other. According to this modification, both the split components 40 and 50 can be welded together with the sealing plate-side inclined faces 12*c* pressed against the accommodation recess-side inclined faces by a pressing force during vibration welding. Thus, the sealing performance between the outer periphery of each internal pipe 12 and the associated upper concave part 41 of the upper split component 40 can be further enhanced.

Figure 10:
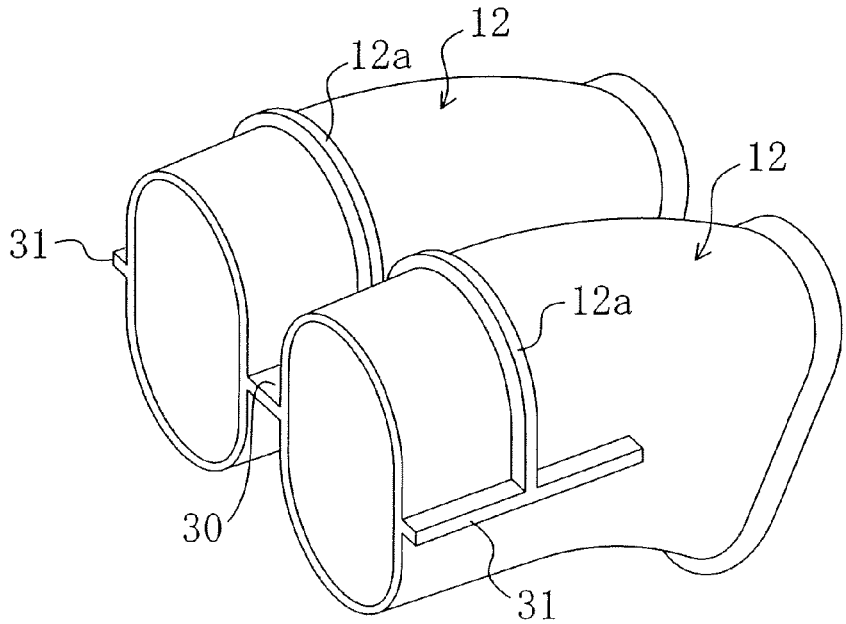
FIG. 10 is a corresponding view of FIG. 6 according to Modification 2 of the above embodiment.

Alternatively, as in Modification 2 shown in FIG. 10, each sealing plate 12*a* may be of arcuate shape along the outer periphery of the associated internal pipe 12. Thus, the sealing plate 12*a* can have a smaller size than that of rectangular shape and in turn the associated accommodation recess 42 can be reduced in size.

Although in the above embodiment each sealing plate 12*a* is provided at an end of the associated internal pipe 12, the present invention is not limited to this. For example, each sealing plate 12*a* may be provided in the axial middle of the internal pipe 12.

Figure 11:
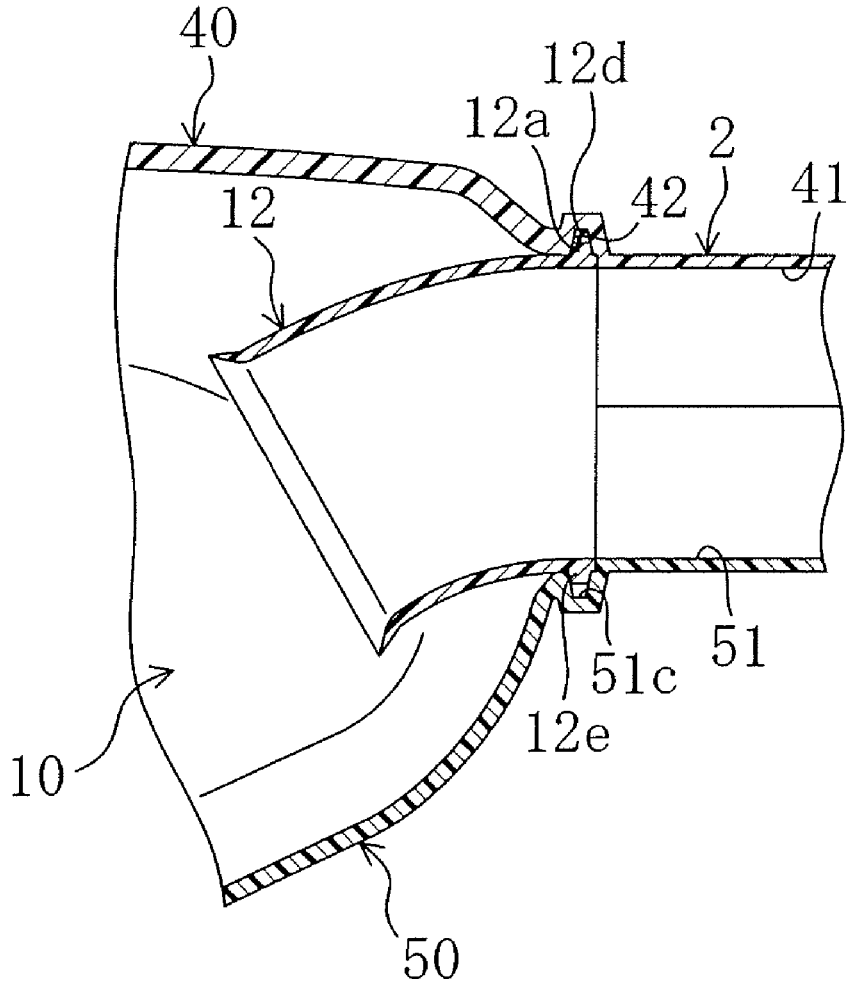
FIG. 11 is an enlarged cross-sectional view showing an internal pipe and its vicinity in an intake manifold according to Modification 3 of the above embodiment.

Alternatively, as in Modification 3 shown in FIG. 11, the length of each internal pipe 12 may be shortened to lessen the distance of insertion of the internal pipe 12 into the intake pipe 2. Furthermore, as shown in FIG. 11, each internal pipe 12 may have a radially outwardly extending extension plate 12*e* on the lower half of its outer periphery. In this case, each lower concave part 51 of the lower split component 50 is provided with a recess 51*c* into which the associated extension plate 12*e* is fitted.

Furthermore, as shown in FIG. 11, the upper edge of each sealing plate 12*a* may be provided with a flexible projection 12*d* in contact in a bent position with the inner face of the accommodation recess 42, such as the bottom. Thus, variations in the molding accuracy of the sealing plate 12*a* and the accommodation recess 42 can be absorbed by the bending deformation of the flexible projection 12*d*, which further enhances the sealing performance between the outer periphery of the associated internal pipe 12 and the associated upper concave part 41 of the upper split component 40.

During vibration welding, the lower split component 50 may be vibrated with the upper split component 40 fixed.

The present invention is applicable not only to intake manifolds for horizontally opposed engines but also to those for various types of engines including inline engines and V-engines. Furthermore, the number of intake pipes 2, 3 can be appropriately selected according to the number of engine cylinders.

INDUSTRIAL APPLICABILITY

As can be seen from the above, the resin intake manifold according to the present invention is suitable for placement in intake systems of motor vehicle engines.

What is claimed is:

1. A resin intake manifold including: a manifold body including an intake pipe and a surge tank connected to an end of the intake pipe located upstream in the flow of intake air; and an internal pipe placed in the intake pipe and extending to the interior of the surge tank, the manifold body being composed of first and second split components joined together along a parting plane extending radially and longitudinally of the intake pipe by vibration welding, wherein the first and second split components include first and second concave parts, respectively, forming the inner periphery of the intake pipe so that a downstream part of the internal pipe is placed between the first and second concave parts, the second concave part is formed a distance away from the outer periphery of the internal pipe, the internal pipe includes a fitting part formed in a portion of the outer periphery of the downstream part thereof corresponding to the first concave part and fitted into the first concave part and a sealing part formed on a portion of the outer periphery of the downstream part thereof corresponding to the second concave part and extending radially outwardly, the second concave part has an accommodation recess accommodating the sealing part, and the inner face of the accommodation recess and the sealing part are formed along the direction of vibration of the vibration welding and are in contact with each other.

2. The resin intake manifold of claim 1, wherein the sealing part has a sealing part-side inclined face inclined with respect to the direction of pressure application during the vibration welding, part of the inner face of the accommodation recess is an accommodation recess-side inclined face conforming to the sealing part-side inclined face, and the sealing part-side inclined face and the accommodation recess-side inclined face are in contact with each other.

3. The resin intake manifold of claim 1, wherein the intake pipe comprises a plurality of intake pipes, the internal pipe comprises a plurality of internal pipes, one internal pipe in each of the plurality of intake pipes, and the sealing part comprises a plurality of sealing parts, all or some of the plurality of sealing parts being integral.

4. The resin intake manifold of claim 3, wherein the plurality of intake pipes are radially juxtaposed, each radially adjacent pair of the plurality of internal pipes are joined by a connecting part provided therebetween, one of the first and second split components includes a welding raised part welded to the other split component, the welding raised part being located between each radially adjacent pair of the plurality of internal pipes, and the connecting part has a through hole into which the welding raised part is inserted.

5. The resin intake manifold of claim 1, wherein the sealing part includes a flexible projection in contact in a bent position with the inner face of the accommodation recess.

* * * * *